US005238303A

United States Patent [19]

Dixon

[11] Patent Number: 5,238,303

[45] Date of Patent: Aug. 24, 1993

[54] METHOD OF AND APPARATUS FOR MIXING OF FLUENT MATERIALS ENCLOSED IN A BAG

[76] Inventor: James D. Dixon, 17735 Vierra Canyon Rd., Salinas, Calif. 93907

[21] Appl. No.: 298,364

[22] Filed: Jan. 18, 1989

[51] Int. Cl.[5] ..... B01F 11/00; B01F 9/00

[52] U.S. Cl. ..... 366/218; 198/771; 366/219; 366/108

[58] Field of Search ..... 366/219, 109, 271, 108, 366/218, 208, 349; 99/348, 277.2, 360, 362, 395, 409; 198/771, 463.5, 460; 15/3.1, 3.13, 3.16, 3.21

[56] References Cited

U.S. PATENT DOCUMENTS

| | | | |
|---|---|---|---|
| 2,380,910 | 7/1945 | Newton | 366/218 X |
| 2,960,319 | 11/1960 | Carvallo | 366/109 |
| 3,083,547 | 4/1963 | Stevens | 366/219 X |
| 3,318,446 | 5/1967 | Grow | 366/109 X |
| 3,558,105 | 1/1971 | Moritz | 366/109 |
| 3,618,741 | 11/1971 | Berndt | 198/463.5 |
| 3,700,090 | 10/1972 | Pearson | 198/463.5 X |
| 4,120,393 | 10/1978 | Motooka et al. | 198/460 |
| 4,313,535 | 2/1982 | Carmichael | 198/766 |
| 4,541,521 | 9/1985 | Menge | 198/463.5 |
| 4,844,236 | 7/1989 | Kraus | 198/771 X |

FOREIGN PATENT DOCUMENTS

| | | | |
|---|---|---|---|
| 759117 | 8/1980 | U.S.S.R. | 366/218 |

*Primary Examiner*—Harvey C. Hornsby
*Attorney, Agent, or Firm*—Paul B. Fihe

[57] ABSTRACT

A method is described herein which provides for mixing of fluent materials enclosed in a flexible bag. The bags are conveyed in sequence along a conveying member which is vibrated to effect bag motion and turning thereof during the advance. Advance is blocked by one or more low baffles but turning of each blocked bag continues, but when a succeeding bag engages the blocked bag, it turns in the opposite direction so as to ride over the blocking baffle and continue in its advance. Apparatus for automatically carrying out the method steps is also described.

10 Claims, 2 Drawing Sheets

METHOD OF AND APPARATUS FOR MIXING OF FLUENT MATERIALS ENCLOSED IN A BAG

FIELD OF THE INVENTION

The present invention relates generally to mixing processes and, more particularly, to a method of and apparatus for mixing fluent material enclosed within a flexible bag or other container.

BACKGROUND OF THE INVENTION

There are innumerable instances where mixing of materials enclosed within some form of container is required. Such materials are, of course, miscible and may be in the form of gases, liquids, granular, particulate, or some other form of fluent materials. As one example with which the present invention is expecially concerned, in the production of mushroom spawn, a small quantity of mycelium is introduced in a much larger quantity of grain and enclosed in a flexible bag where growth can occur. However, to establish a thorough distribution, mixing of the materials within the bag is requisite. Most commonly, such mixing is accomplished by manual manipulation of the flexible bag which, as will be obvious, is a tedious operation that is not only inefficient, but also is not too effective.

SUMMARY OF THE PRESENT INVENTION

Accordingly, it is the general objective of the present invention to provide a method of mixing fluent materials in a bag by effective turning and vibration action of the bag to effect thorough intermixing of the bag contents. Apparatus for automatically carrying out the method by a relatively simple mechanical action constitutes an ancillary objective of the invention.

To achieve such objective, the method involves as a first step the convevance of the bags in spaced sequence along a predetermined path. Preferably such conveyance is achieved by frictional engagement of the bags with a longitudinally vibrating and supporting surface which will effect a shaking of the bags and at the same time a turning thereof in one direction.

Periodically, the conveyed advance of each bag is temporarily blocked by a series of baffles positioned above the moving and supporting surface. During the blocked advance of each bag, vibration and turning thereof continues and contact with the blocking baffle enhances the intermixing of the bag contents.

When a succeeding bag is brought into contact with the blocked bag, the rotation of the succeeding bag effects reverse rotation of the blocked bag, in a manner analgous to the engagement of gears, whereupon the blocked bag can climb over the blocking baffle for subsequent conveyence. The action continues over a series of conveyer sections and baffles so that a complete intermingling of the contents is assured.

In accordance with an ancillary aspect of the invention, the steps of the method are carried out automatically with an apparatus providing for conveyance of the bags along a predetermined path and contact during such conveyance so that turning of the bags and effective mixing of the bag contents are experienced during the conveyance. The conveying member is in the form of an elongated trough which preferably provides frictional contact and conveyance of the bags as a result of vibratory motion such as that shown in U.S. Pat. No. 4,313,535. As there shown and described in detail, the conveying member is mounted by a plurality of beam springs above a frame which is excited for back and forth motion from an attached vibratory drive means.

In accordance with the present invention, the bottom of the conveying trough is composed of a rough surface which advances and turns the bags as they pass successively thereover as a result of the vibratory action. At periodic intervals at least twice as great as the diameter of a single bag, low baffles are mounted to transversely bridge the conveying trough so as to temporarily block the conveyance or advance of an adjacent bag. When a succeeding bag engages the blocked bag, the turning or rotation of the succeeding bag engages the blocked bag so as to effect rotation of it in the opposite direction so that the blocked bag will ride over the low baffle for further conveyance.

Preferably the baffle includes an upright section less than bag diameter and a somewhat resilient section directed opposite to the direction of conveyance and having an undulating, sinusoidal edge wherefore contact with an adjacent bag will effect distribution of the bag contents rearwardly and laterally relative to the general direction of the bag conveyance.

After traverse of the entire length of the conveying member and periodic engagement with the plurality of baffles, a full intermixture of the bag contents is assured.

BRIEF DESCRIPTION OF THE DRAWINGS

The foregoing brief description of the inventive method and apparatus for carrying out the same automatically will be more fully understood by the reference to the following detailed description of the apparatus shown in the accompanying drawings wherein.

DETAILED DESCRIPTION OF THE ILLUSTRATED EMBODIMENT OF THE INVENTION

Figure 1:
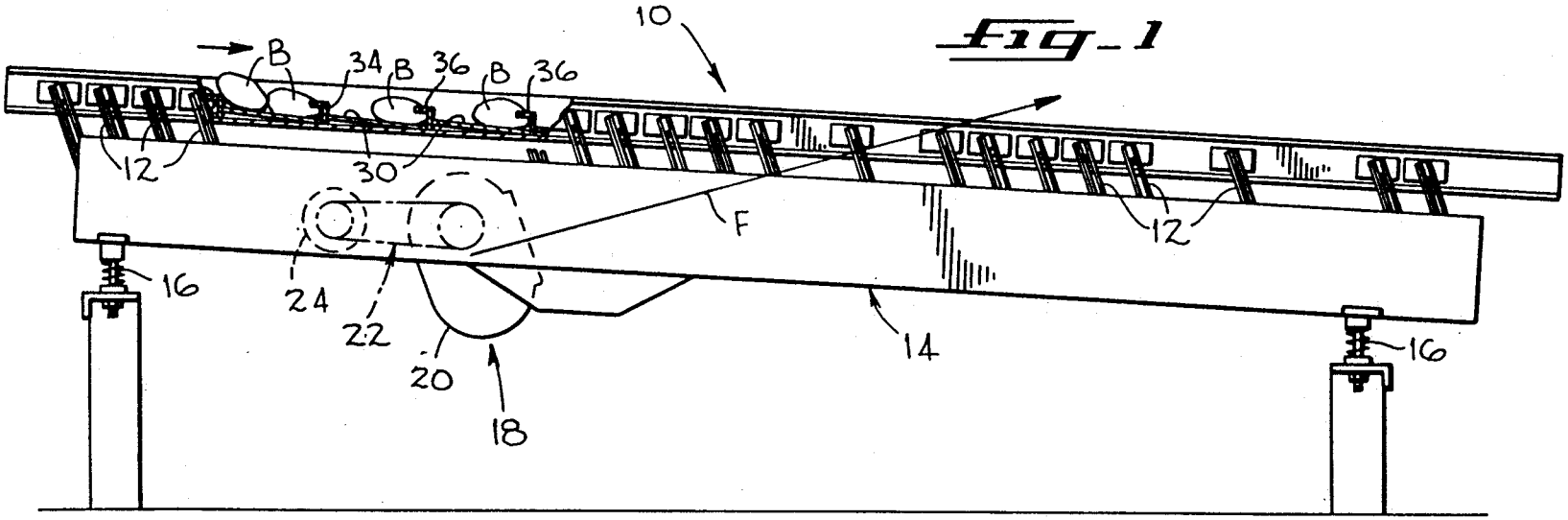
FIG. 1 is a side elevational view of an apparatus embodying the invention.

With initial reference to FIG. 1, the illustrated apparatus for automatically carrying out the method of the present invention includes an enlongated conveying member 10 in the form of a generally U-shaped trough which is mounted at spaced intervals on both sides at the upper ends of a plurality of beam springs 12. The beam springs extend upwardly and at a slight rearward angle as discussed in detail in U.S. Pat. No. 4,313,535 to which reference is made for construction and operational details.

Also as described in that Patent, the lower ends of the beam springs 12 are secured to an excited frame 14 mounted at its four corners by resilient legs 16 carried on a supporting floor or other surface. Preferably in the present case, the legs at the entrance end are slightly longer than the legs at the exit end of the apparatus wherefore the excited frame 14 and the conveying trough 10 extend slightly downwardly at an angle of 3.75° in the direction of conveyance.

A balanced vibratory drive means generally indicated at 18 is attached to the excited frame. As indicated, such drive means includes a balanced counter-rotating vibrator 20 which when driven by a belt and pully connection 22, to a suitable variable speed drive motor 24 (e.g. 1 HP) effects vibration of the excited frame along a line of force indicated by the arrow F which is substantially perpendicular to the face of the beam springs 12. The total vibratory stroke is preferably between ⅝ inch and ¾ inch and can be varied by changing the speed of the motor having an average rotative speed of 1020 r.p.m. Reference is again made to the aforementioned U.S. Patent for structural and operational details.

Figure 5:
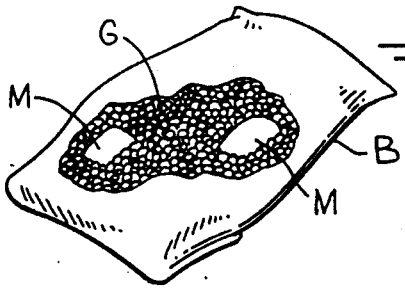
FIG. 5 is a perspective view of a flexible bag whose contents are intermixed during operation of the apparatus.

The bag B whose contents are to be mixed is shown in FIG. 5. In this instance, the bag is flexible and when filled with a large quantity of grain G and two small portions of an inoculum such as mycelium M will assume, when placed on a flat surface, a length of approximately 14 inches, a width of approximately 6 inches and a height of approximately 4 inches. This filled bag will weigh about 6 pounds.

Figure 3:
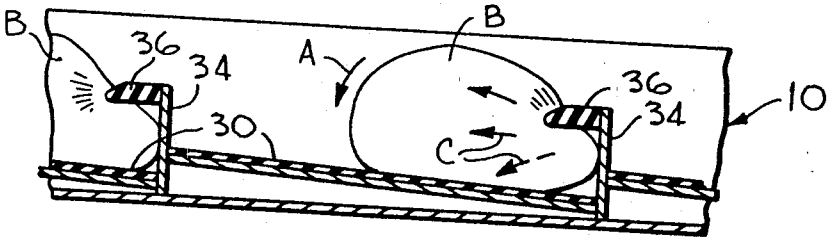
FIG. 3 is a transverse sectional view taken along line 3—3 of FIG. 2.
Figure 4:
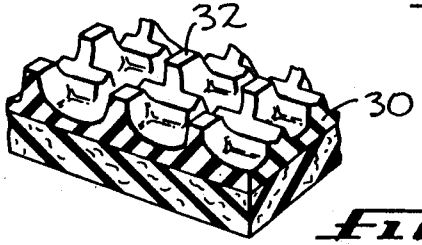
FIG. 4 is a greatly enlarged fragmentary perspective view of a portion of the conveying surface.
Figure 2:
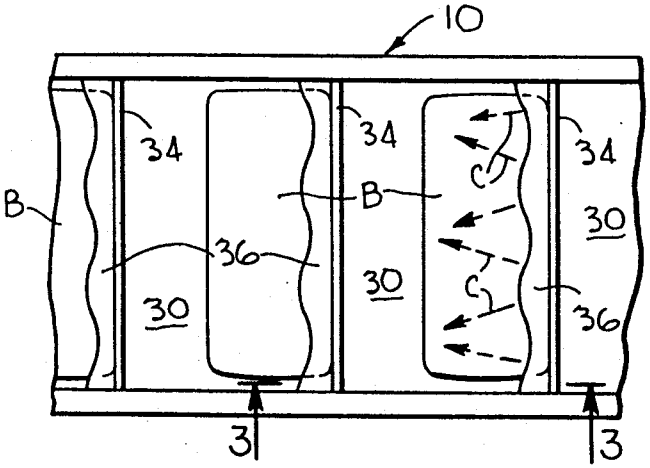
FIG. 2 is an enlarged fragmentary top plan view of a portion of the FIG. 1 apparatus.

To perform the mixing method of the present invention on this particular filled bag, the conveying trough 10 should be wider than the bag length (e.g. 19 inches) and will have placed therein a plurality of belt sections 30 longer than the width of two bags (e.g. 12 inches) and having a frictional surface 32 as indicated, for example, by a commercially available friction belt as shown best in FIG. 4. Preferably each belt section 30 is supported at a slight downward angle (e.g. 5°) relative to the bottom of the trough 10. Therefore, when the forward vibratory stroke occurs, a bag B on the belt will experience a forward conveyance but at the same time will also experience a counter-clockwise rotation as indicated by the arrow A in FIG. 3, thus initiating some mixing of the bag contents. At the end of each belt section 30, a baffle 34 rises about 3 inches above the adjacent belt surface and has a rearwardly-extending flange 36 composed of rubber or other resilient material and having a generally undulating, sinusoidal edge directed oppositely to the general direction of conveyance. Thus when a filled bag B engages the flange 36 and baffle 34, its progress will be temporarily blocked but it will continue to rotate in a counter-clockwise direction as shown clearly in FIG. 3. Furthermore, because of the flange undulations, mixing forces will be directed both rearwardly and laterally against the bag as indicated by the plurality of small arrows C in FIGS. 2 and 3. Thus, the mixing action is further enhanced.

The manner in which the temporarily blocked bags can be further advanced can best be visualized by reference to the operational sequence shown in FIGS. 6A–6E.

Figure 6A:
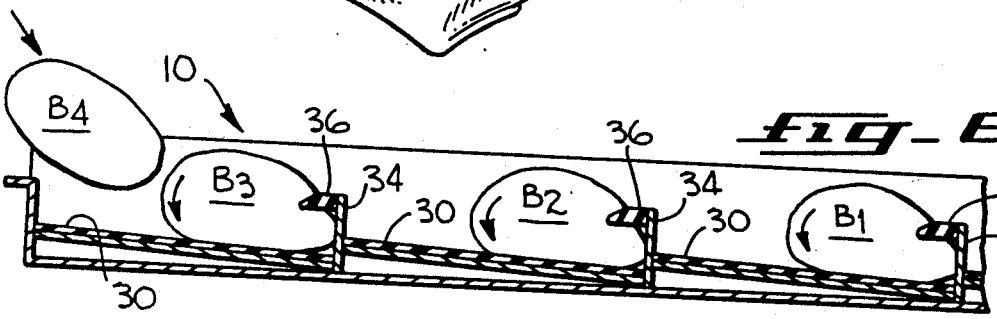
FIGS. 6A–6E are a series of diagrammatic views showing a sequence of the bag positions during the operation.
Figure 6B:
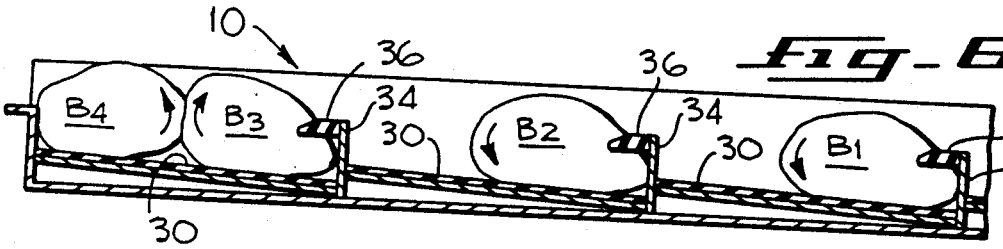
Figure 6C:
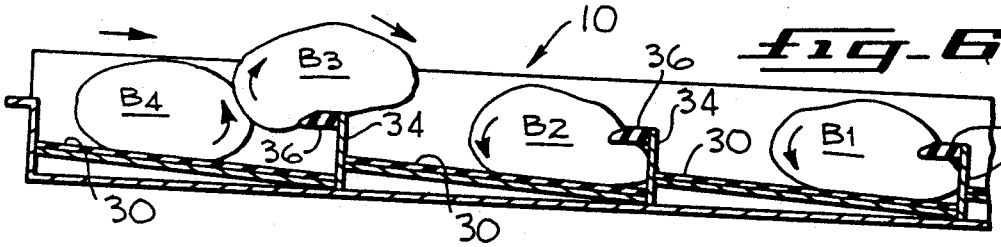
Figure 6D:
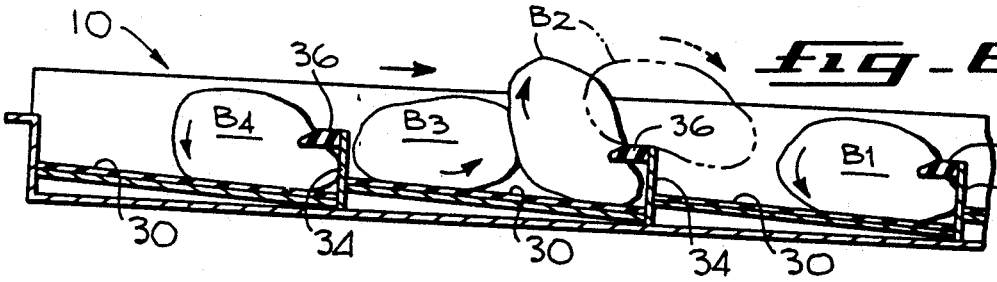
Figure 6E:
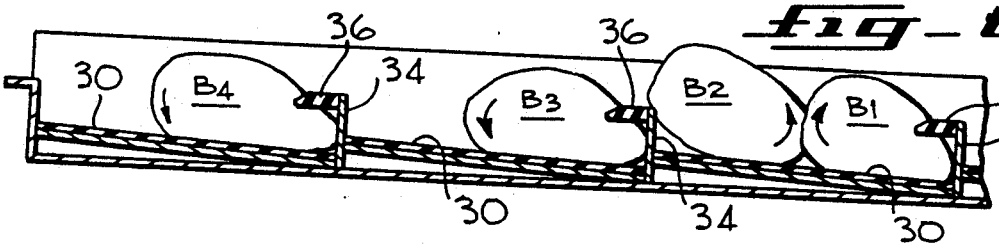

As shown in FIG. 6A, three bags $B_1$,$B_2$, $B_3$ are shown in blocked dispositions rotating in counter-clockwise directions so the mixing action continues as previously described. When a fourth bag $B_4$ is moved into contact with the belt section 30, it will be advanced into contact with the bag $B_3$ and since it is rotating in a counter-clockwise direction, such engagement will initiate a reversed clockwise rotation of the bag $B_3$ (similar to meshing gears) and cause it to climb over the flange 36 and baffle 34 in the manner indicated in FIG. 6C. The bag $B_3$ will thereafter come into contact with bag $B_2$ as shown in FIG. 6D and it will climb over the baffle 34 and flange 36 to come into contact with bag $B_1$ as indicated in FIG. 6E.

The bags $B_4$ and $B_3$ will, of course, continue to rotate in a counter-clockwise direction to continue the mixing action until a further bag is introduced to function in the fashion described.

Obviously, various modifications and/or alterations can be made, for example, in the conveyor structure and dimensional details for various other bags or containers, and the foregoing description of the method and apparatus for carrying out the same are not to be considered as limiting, and the actual scope of the invention is to be indicated only by the appended claims.

What is claimed is:

1. The method of mixing fluent material enclosed within a flexible bag which comprises the steps of conveying a plurality of the bags in sequence along a predetermined path, by fore and aft vibratory motion of a supporting and moving surface frictionally engaging the bags to effect vibration and bag turning in one direction during such conveyance, temporarily blocking the conveyance of a first individual bag and engaging the first individual blocked bag with a succeeding turning bag in a fashion to turn the first bag in the reverse direction and continue conveyance of the first individual bag past the temporary blocked position.

2. The method of mixing fluent material enclosed within a flexible bag according to claim 1 wherein the temporary blocking of bag conveyance is achieved by placing a baffle in the predetermined path above the moving and supporting surface.

3. The method of mixing fluent material enclosed within a flexible bag according to claim 2 wherein the engagement of the first bag with a succeeding bag effects reversed rotation of the first bag to effect movement thereof over the blocking baffle.

4. The method of mixing fluent material enclosed in a flexible bag according to claim 1 wherein the temporary blocking of bag conveyance is achieved repetitively by placing a sequence of baffles in the predetermined path above the moving and supporting surface.

5. Apparatus for mixing fluent materials enclosed in a flexible bag which comprises means for conveying the bags in a sequence along a predetermined path including a friction belt, and means for effecting vibratory action of said belt to effect advance and turning of each bag in one direction, at least one baffle disposed above said conveying means to temporarily block forward conveyance of a bag positioned thereagainst, said advance and turning of a succeeding bag against the blocked bag effecting reversed turning movement of the blocked bag over said baffle for continued conveyance.

6. Apparatus for mixing fluent materials enclosed in a flexible bag according to claim 5 wherein said friction belt slopes downwardly in the direction of conveyance.

7. Apparatus for mixing fluent materials enclosed in a flexible bag according to claim 5 wherein a plurality of baffles are disposed above said belt at spaced intervals, each interval being at least twice the width of a single bag.

8. Apparatus for mixing fluent materials enclosed in a flexible bag according to claim 5 wherein said baffle includes an upright section and a flange extending rearwardly relative to the direction of conveyance.

9. Apparatus for mixing fluent materials enclosed in a flexible bag according to claim 8 wherein said flange is resilient.

10. Apparatus for mixing fluent material enclosed in a flexible bag according to claim 9 wherein said rearwardly-extending flange has an undulating edge.

* * * * *